US010577160B2

(12) United States Patent
Zacherle

(10) Patent No.: US 10,577,160 B2
(45) Date of Patent: Mar. 3, 2020

(54) CARTON HAVING DISPENSING FEATURE AND BLANK THEREFOR

(71) Applicant: WestRock Packaging Systems, LLC, Atlanta, GA (US)

(72) Inventor: Matthew E. Zacherle, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 16/070,375

(22) PCT Filed: Jan. 20, 2017

(86) PCT No.: PCT/US2017/014237
§ 371 (c)(1),
(2) Date: Jul. 16, 2018

(87) PCT Pub. No.: WO2017/127615
PCT Pub. Date: Jul. 27, 2017

(65) Prior Publication Data

US 2019/0016513 A1 Jan. 17, 2019

Related U.S. Application Data

(60) Provisional application No. 62/281,240, filed on Jan. 21, 2016.

(51) Int. Cl.
*B65D 71/36* (2006.01)
*B65D 5/02* (2006.01)
(Continued)

(52) U.S. Cl.
CPC ..... *B65D 71/36* (2013.01); *B65D 5/0227* (2013.01); *B65D 5/5445* (2013.01); *B65D 5/703* (2013.01);
(Continued)

(58) Field of Classification Search
CPC ..... B65D 71/36; B65D 2571/0045; B65D 2571/00728; B65D 2571/0066; B65D 2571/00141; B65D 5/0227
(Continued)

(56) References Cited

U.S. PATENT DOCUMENTS 4,398,636 A 8/1983 Baxter
5,906,313 A 5/1999 Oliff
(Continued)

FOREIGN PATENT DOCUMENTS

WO WO2005092735 A2 10/2005
WO WO2006042185 A1 4/2006
WO WO2006086593 A1 8/2006

*Primary Examiner* — King M Chu
(74) *Attorney, Agent, or Firm* — WestRock Intellectual Property Group

(57) ABSTRACT

Carton (90) containing a plurality of containers (C) includes a dispenser defined by a dispenser (80) pattern (40) extending through the carton's first side panel (14), top panel (16), second side panel (18), and exiting end panel (84). The dispenser (80) is at least partially separable along the dispenser pattern (40) to form an opening into an interior of the carton (90). The dispenser pattern (40) includes first and second tear lines (51, 52) on first and second side exiting end flaps (32, 36) that extend downwardly toward one another from opposite sides of the exiting end panel. The first and second end dispenser patterns do not extend completely across respective first and second side exiting end flaps but stop short of an outer edge of respective first and second side exiting end flaps.

19 Claims, 9 Drawing Sheets

(51) Int. Cl.
*B65D 5/54* (2006.01)
*B65D 5/70* (2006.01)

(52) U.S. Cl.
CPC ..... *B65D 2571/0058* (2013.01); *B65D 2571/0066* (2013.01); *B65D 2571/00141* (2013.01); *B65D 2571/00728* (2013.01)

(58) Field of Classification Search
USPC ..... 206/139; 229/122, 242
See application file for complete search history.

(56) References Cited

U.S. PATENT DOCUMENTS

| | | | |
|---|---|---|---|
| 6,273,330 | B1 | 8/2001 | Oliff |
| 7,401,711 | B2 | 7/2008 | Spivey, Sr. |
| 7,648,060 | B2 | 1/2010 | DeBusk |
| 8,444,046 | B2 | 5/2013 | DeBusk et al. |
| 2002/0070139 | A1 | 6/2002 | Bates |
| 2003/0234285 | A1 | 12/2003 | Bates |
| 2005/0189405 | A1* | 9/2005 | Gomes |
| 2007/0023491 | A1* | 2/2007 | Holly |

* cited by examiner

CARTON HAVING DISPENSING FEATURE AND BLANK THEREFOR

CROSS-REFERENCE TO RELATED APPLICATIONS

This application is a National Phase application of PCT Application PCT/US2017/014237, filed Jan. 20, 2017, which claims the benefit of U.S. Provisional Patent Application No. 62/281240, filed Jan. 21, 2016, both of which are incorporated herein by reference in their entirety.

TECHNICAL FIELD

The present invention relates to a carton for containing articles, to a blank for forming the carton, and more particularly to a carton having an improved dispensing feature.

BACKGROUND

Enclosed cartons with dispensing features have been used in the past. Many of these cartons include article dispensers defined by lines of disruption such as tear lines, cuts, score lines, and fold lines. A dispenser may be removable from, or hingedly attached to, a carton to create an opening from which articles can be removed from the carton. One problem with many conventional carton dispensers is that they may be difficult for a user to remove. Another problem with conventional carton dispensers is that they do not facilitate a user's ability to choose between two dispensing configurations, a first configuration in which the dispenser remains partially connected to a remaining portion of the carton and a second configuration in which the dispenser has been completely separated from the remaining portion of the carton. The present invention seeks to overcome or at least mitigate the problems of the prior art.

SUMMARY

A first aspect of the invention provides a blank for forming a carton for containing a plurality of articles. The blank comprises a plurality of main panels hinged together in a linear series. The plurality of main panels is configured to form a tubular structure in a set-up carton. The main panels comprise a bottom panel, a first side panel, a top panel, and a second side panel. The blank also comprises a plurality of exiting end flaps configured to form a front panel in the set-up carton. The front panel is configured to close a front end of the tubular structure. The exiting end flaps comprise a first side exiting end flap hingedly connected to the first side panel along a first marginal area of the blank and a second side exiting end flap hingedly connected to the second side panel along said first marginal area of the blank. The blank further comprises a dispenser pattern extending through the top panel, the first side panel, the second side panel, and the front panel. The dispenser pattern comprises a first end dispenser pattern formed in the first side exiting end flap and a second end dispenser pattern formed in the second side exiting end flap. The first end dispenser pattern comprises a first end first tear line while the second end dispenser pattern comprises a second end first tear line. The first end first tear line and the second end first tear line are configured to extend downwardly toward each other from the opposite sides of the front panel in the set-up carton. The first and second end dispenser patterns do not extend completely across respective first and second side exiting end flaps but stop short of the outer edge of the respective first and second side exiting end flaps. The first end first tear line and second end first tear line are configured to define at least in part the lower edge of an at least partially removable dispenser in the set-up carton.

Optionally, the first end first tear line may define a first axis and the second end first tear line may define a second axis. A first angle between the first axis and a horizontal axis of the front panel may be at least about five degrees. A second angle between the second axis and the horizontal axis of the front panel may be at least about five degrees.

Optionally, the dispenser pattern may be configured so as to leave at least a portion of the dispenser connected to a remaining portion of the set-up carton when the dispenser is fully opened.

Optionally, the dispenser pattern may be configured so as to give a user of the set-up carton the option of either partially or completely removing the dispenser from a remaining portion of the set-up carton when the dispenser is fully opened.

Optionally, the first end dispenser pattern may comprise a first J-shaped cut disposed at or adjacent to the terminal end of the first end first tear line. The second end dispenser pattern may comprise a second J-shaped cut disposed at or adjacent to the terminal end of the second end first tear line. The first and second J-shaped cuts may be configured to arrest further tearing of the front panel in the set-up carton.

Optionally, the first end first tear line may comprise a first plurality of shallow V-shaped cuts. Each of the first plurality of shallow V-shaped cuts may comprise a first leg generally coincident with an axis of the first end tear first line and a second leg angled slightly out of the axis of the first end first tear line and toward a top of the set-up carton. The second end first tear line may comprise a second plurality of shallow V-shaped cuts. Each of the second plurality of shallow V-shaped cuts may comprise a first leg generally coincident with an axis of the second end first tear line and a second leg angled slightly out of the axis of the second end first tear line and toward the top of the set-up carton.

Optionally, the blank may further comprise a first side dispenser pattern formed in the first side panel and a second side dispenser pattern formed in the second side panel. The first side dispenser pattern may comprise a first side first tear line angled obliquely toward a back and bottom of the set-up carton and a first side second tear line angled obliquely toward the front panel and top of the set-up carton. A terminal end of the first side second tear line may be disposed at or adjacent to a beginning end of the first end first tear line. The second side dispenser pattern may comprise a second side first tear line angled obliquely toward the back and bottom of the set-up carton and a second side second tear line angled obliquely toward the front panel and top of the set-up carton. A terminal end of the second side second tear line may be disposed at or adjacent to a beginning end of the second end first tear line.

Optionally, the first side dispenser pattern may comprise a first side curved tear line connecting the first side first tear line and the first side second tear line, and the second side dispenser pattern may comprise a second side curved tear line connecting the second side first tear line and the second side second tear line.

Optionally, the first end dispenser pattern may comprise a first end second tear line disposed at or adjacent to a terminal end of the first end first tear line. The first end second tear line may curve down toward a bottom of the set-up carton. The second end dispenser pattern may comprise a second end second tear line disposed at or adjacent to a terminal end of the second end first tear line. The second end second tear line may curve down toward a bottom of the set-up carton.

Optionally, the first end dispenser pattern may comprise a first J-shaped cut disposed at or adjacent a terminal end of the first end second tear line. The second end dispenser pattern may comprise a second J-shaped cut disposed at or adjacent a terminal end of the second end second tear line. The first J-shaped cut may be disposed within relatively close proximity of a bottom edge of the first side exiting end flap, and the second J-shaped cut may be disposed within relatively close proximity of a bottom edge of said second side exiting end flap.

Optionally, the first end dispenser pattern and the second end dispenser pattern may be configured so as to allow a user to completely remove the dispenser when the dispenser is fully opened. Complete removal of the dispenser tends to cause generally vertical tearing of the first side exiting end flap through a region of said first side exiting end flap extending between the first J-shaped cut and the bottom edge of said first side exiting end flap. The complete removal of the dispenser may be further configured to cause generally vertical tearing of the second side exiting end flap through a region of the second side exiting end flap extending between the second J-shaped cut and the bottom edge of the second side exiting end flap.

The second aspect of the invention provides a carton and a plurality of articles contained therein. The carton comprises a top panel, a bottom panel, a first side panel coupled to both the top panel and the bottom panel, a second side panel disposed opposite the first side panel and coupled to both the top panel and the bottom panel, a back end panel disposed at a back end of the carton, an exiting end panel disposed at a front end of the carton, the exiting end panel comprising a first side exiting end flap and a second side exiting end flap, and a dispenser defined by a dispenser pattern. The dispenser pattern defines a dispenser flap that is separable along the dispenser pattern to form an opening into an interior of the carton. The dispenser pattern extends at least through the top panel, the first side panel, the second side panel, and the exiting end panel. The dispenser pattern comprises a first end dispenser pattern formed in the first side exiting end flap and a second end dispenser pattern formed in the second side exiting end flap. The first end dispenser pattern comprises a first end first tear line while the second end dispenser pattern comprises a second end first tear line. The first end first tear line and the second end first tear line extend downwardly toward one another from the opposite sides of the exiting end panel. The first and second end dispenser patterns do not extend completely across the respective first and second side exiting end flaps but stop short of the outer edge of the respective first and second side exiting end flaps.

Optionally, the plurality of containers may comprise a plurality of cans.

Optionally, the plurality of cans may be arranged on their sides in at least two stacked rows, wherein a width of each of the top panel and the bottom panel may be about equal to or slightly greater than a characteristic height of each of the plurality of cans.

Optionally, the first end first tear line may define a first axis while the second end first tear line may define a second axis. A first angle between the first axis and a horizontal axis of the front panel may be at least about five degrees while a second angle between the second axis and the horizontal axis of the front panel may be at least about five degrees.

Optionally, the dispenser pattern may be configured so as to leave at least a portion of the dispenser flap connected to a remaining portion of the carton when the dispenser is fully opened.

Optionally, the dispenser pattern may be configured so as to give a user of the carton the option of either partially or completely removing the dispenser flap from a remaining portion of the carton when the dispenser is fully opened.

Optionally, the first end dispenser pattern may comprise a first J-shaped cut disposed at or adjacent to a terminal end of the first end first tear line. The second end dispenser pattern may comprise a second J-shaped cut disposed at or adjacent to a terminal end of the second end first tear line. The first and second J-shaped cuts may be configured 6 to arrest further tearing of the exiting end panel.

Optionally, the first end first tear line may comprise a first plurality of shallow V-shaped cuts. Each shallow V-shaped cut of the first plurality may comprise a first leg generally coincident with an axis of the first end tear first line and a second leg angled slightly out of the axis of the first end first tear line and toward the top panel. The second end first tear line may comprise a second plurality of shallow V-shaped cuts. Each shallow V-shaped cut of the second plurality may comprise a first leg generally coincident with an axis of the second end first tear line and a second leg angled slightly out of the axis of the second end first tear line and toward the top panel.

Optionally, the carton may further comprise a first side dispenser pattern formed in the first side panel and a second side dispenser pattern formed in the second side panel. The first side dispenser pattern may comprise a first side first tear line angled obliquely toward the back and bottom panels of the carton and a first side second tear line angled obliquely toward the exiting end panel and top panel. A terminal end of the first side second tear line may be disposed at or adjacent to a beginning end of the first end first tear line. The second side dispenser pattern may comprise a second side first tear line angled obliquely toward the back and bottom panels and a second side second tear line angled obliquely toward the exiting end panel and top panel. A terminal end of the second side second tear line may be disposed at or adjacent to a beginning end of the second end first tear line.

Optionally, the first side dispenser pattern may comprise a first side curved tear line connecting the first side first tear line and the first side second tear line while the second side dispenser pattern comprises a second side curved tear line connecting the second side first tear line and the second side second tear line.

Optionally, the first end dispenser pattern may comprise a first side second tear line disposed at or adjacent to a terminal end of said first end first tear line. The first end second tear line may curve down toward the bottom panel. The second end dispenser pattern may comprise a second end second tear line disposed at or adjacent to a terminal end of the second end first tear line. The second end second tear line may curve down toward the bottom panel.

Optionally, the first end dispenser pattern may comprise a first J-shaped cut disposed at or adjacent a terminal end of the first end second tear line. The second end dispenser pattern may comprise a second J-shaped cut disposed at or adjacent a terminal end of said second end second tear line. The first J-shaped cut may be disposed within relatively close proximity of a bottom edge of the first side exiting end flap. The second J-shaped cut may be disposed within relatively close proximity of a bottom edge of the second side exiting end flap.

Optionally, the first end dispenser pattern and the second end dispenser pattern may be configured so as to allow a user to completely remove the dispenser flap when the dispenser is fully opened. Complete removal of the dispenser flap tends to cause generally vertical tearing of the first side exiting end flap through a region of the first side exiting end flap extending between the first J-shaped cut and the bottom edge of the first side exiting end flap. The complete removal of the dispenser flap may be further configured to cause generally vertical tearing of the second side exiting end flap through a region of the second side exiting end flap extending between the second J-shaped cut and the bottom edge of the second side exiting end flap.

A third aspect of the invention provides a carton for packaging a plurality of articles therein. The carton comprises a top panel, a bottom panel, a first side panel coupled to both the top panel and the bottom panel, a second side panel disposed opposite the first side panel and coupled to both the top panel and the bottom panel, a back end panel disposed at a back end of the carton, an exiting end panel disposed at a front end of the carton, the exiting end panel comprising a first side exiting end flap and a second side exiting end flap, and a dispenser defined by a dispenser pattern. The dispenser pattern defines a dispenser flap that is separable along said dispenser pattern to form an opening into an interior of said carton. The dispenser pattern extends at least through the top panel, the first side panel, the second side panel, and the exiting end panel. The dispenser pattern comprises a first end dispenser pattern formed in the first side exiting end flap and a second end dispenser pattern formed in the second side exiting end flap. The first end dispenser pattern comprises a first end first tear line and a first end second tear line while the second end dispenser pattern comprises a second end first tear line and a second end second tear line.

The first end first tear line and the second end first tear line extend downwardly toward one another from the opposite sides of the exiting end panel. The first end second tear line and the second end second tear line each extends in a predominantly downward direction from the respective point at or adjacent to the terminal end of the respective one of the first end first tear line and second end first tear line. The dispenser is configured so as to create a flexible bridging portion connecting said dispenser flap to a remainder of said carton when said dispenser flap is separated along said dispenser pattern. The flexible bridging portion comprises a region of said exiting end panel extending between said first end second tear line and said second end second tear line.

Optionally, the first end dispenser pattern may comprise a first J-shaped cut disposed at or adjacent a terminal end of the first end second tear line. The second end dispenser pattern may comprise a second J-shaped cut disposed at or adjacent a terminal end of the second end second tear line. The first J-shaped cut may be disposed within relatively close proximity of a bottom edge of said first side exiting end flap while said second J-shaped cut may be disposed within relatively close proximity of a bottom edge of said second side exiting end flap.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the term "carton", for the non-limiting purpose of illustrating the various features of the invention, to a container for engaging, carrying, and/or dispensing articles, such as cans and bottles. However, it is contemplated that the teachings of the invention can be applied to various containers, which may or may not be tapered and/or cylindrical. Other exemplary articles include bottles (for example metallic, glass or plastics bottles), cans (for example aluminium cans), tins, pouches, packets and the like. In this specification, the relative terms "lower," "bottom," "upper" and "top" may indicate orientations determined in relation to fully erected cartons.

Figure 1:
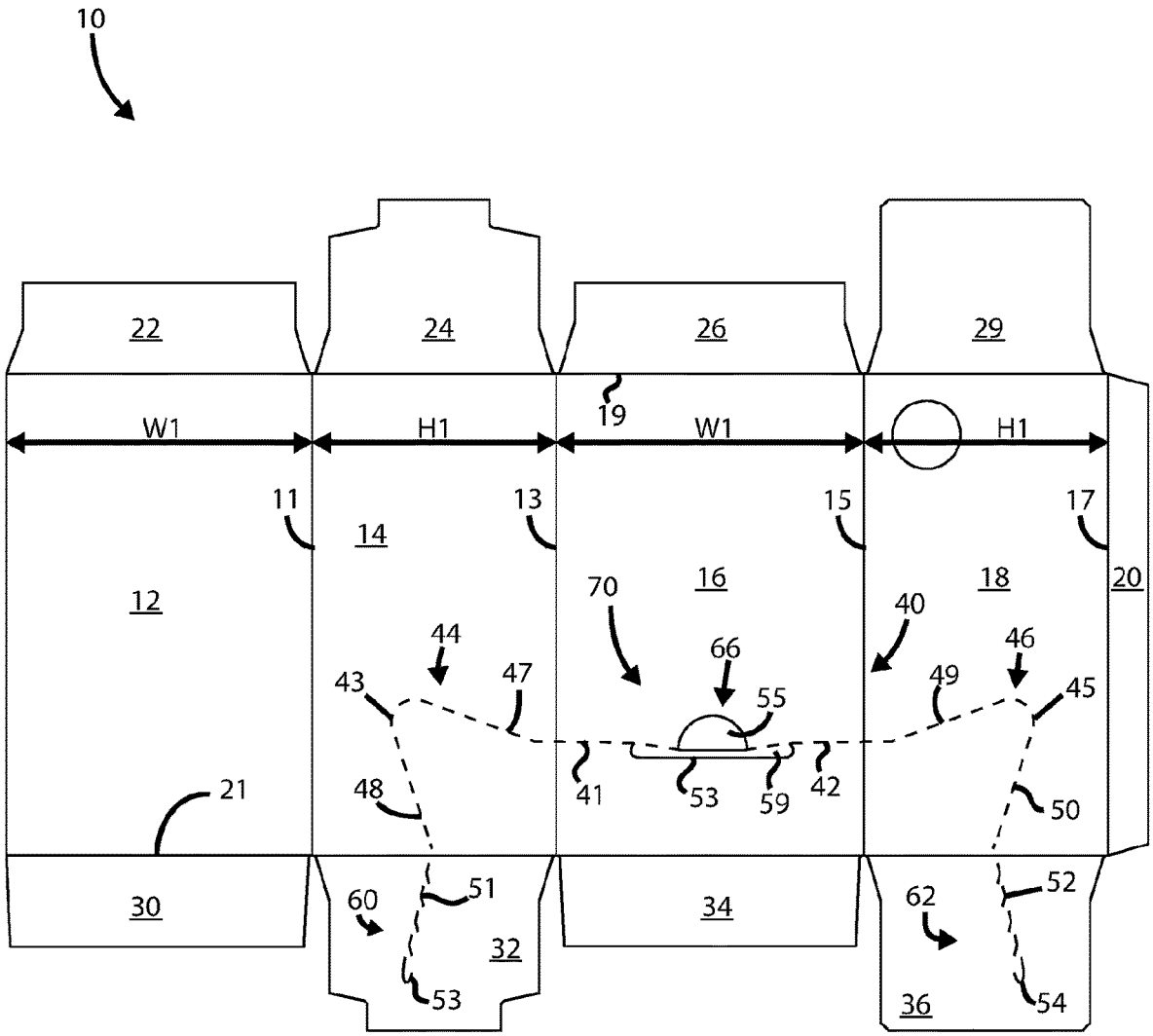
FIG. 1 is a plan view of a blank for forming a carton according to a first embodiment of the invention.

FIG. 1 is a plan view of a blank 10 used to form a carton 90 (illustrated in FIGS. 2-3) according to a first embodiment of the invention. Blank 10 is generally rectangular in shape and includes a plurality of main panels 12, 14, 16, 18 and an adhesive flap 20 hinged together in a linear series. Back end flaps 22, 24, 26, 28 and front or exiting end flaps 30, 32, 34, 36 are hingedly connected at respective ends of a corresponding one of the main panels.

The blank 10 includes a bottom panel 12 hinged to a first side panel 14 by a fold line 11. The first side panel 14 is hinged to a top panel 16 by a fold line 13. The top panel 16 is hinged to a second side panel 18 by a fold line 15. The second side panel 18 is foldably connected to an adhesive flap 20 by a fold line 17.

The bottom panel 12 is foldably connected to a bottom back end flap 22 and a bottom exiting end flap 30. The first side panel 14 is foldably connected to a first side back end flap 24 and a first side exiting end flap 32. The top panel 16 is foldably connected to a top back end flap 26 and a top exiting end flap 34. The second side panel 18 is foldably connected to a second side back end flap 28 and a second side exiting end flap 36. The back end flaps 22, 24, 26, 28 may extend along a first marginal area of the blank 10 and may be foldably connected along a first longitudinally extending fold line 19. The exiting end flaps 30, 32, 34, 36 may extend along a second marginal area of the blank 10 disposed opposite the first marginal area, and may be foldably connected along a second longitudinally extending fold line 21. The longitudinal fold lines 19, 21 may be straight or substantially straight fold lines, or may be offset at one or more locations to account for, for example, blank thickness. When the carton 90 is erected, the end flaps 22, 24, 26, 28 close a back end of the carton 90, and the exiting end flaps 30, 32, 34, 36 close a front or exiting end of the carton 90.

The carton blank 10 includes a dispenser pattern 40 that defines a dispenser 80 in the erected carton 90. The dispenser pattern 40 includes a top dispenser pattern 70 disposed on top panel 16. Top dispenser pattern 70 includes a first top tear line 41 and a second top tear line 42. First top tear line 41 extends in a generally longitudinal direction from a point at or adjacent to fold line 13 to a point at or adjacent to an opening feature 66. Opening feature 66 may be disposed at or near a midpoint of top panel 16 between fold lines 13 and 15. First top tear line 41 may be angled slightly in the direction of the carton's front or exiting end. Second top tear line 42 may generally mirror first top tear line 41. Second top tear line 42 extends in a generally longitudinal direction from a point at or adjacent to fold line 15 to a point at or adjacent to opening feature 66. Second top tear line 42 may be angled slightly in the direction of the carton's front or exiting end. Opening feature 66 can be defined by a semicircular cutout 55 and a fold line 58 that defines an elongated generally rectangular tab 59.

Dispenser pattern 40 also includes a first side dispenser pattern 44 disposed on first side panel 14. In the illustrated embodiment, first side dispenser pattern 44 is generally V-shaped and consists of a first side first tear line 47 and a first side second tear line 48 joined to one another via a rounded tear line 43 which forms the vertex of the V-shape. First side first tear line 47 extends from a point at or adjacent to fold line 13 that is at or adjacent to first top tear line 41 to a point at or adjacent to rounded tear line 43. First side tear first line 47 extends in a predominantly longitudinal direction (i.e., toward the bottom of the constructed carton 90), but is also angled toward the back end of the carton 90. First side second tear line 48 extends from a point at or adjacent to rounded tear line 43 to a point at or adjacent to fold line 21. First side second tear line 48 extends in a predominantly transverse direction (i.e., toward the front end of the constructed carton 90) but is also angled toward the top of the carton 90.

Figure 8:
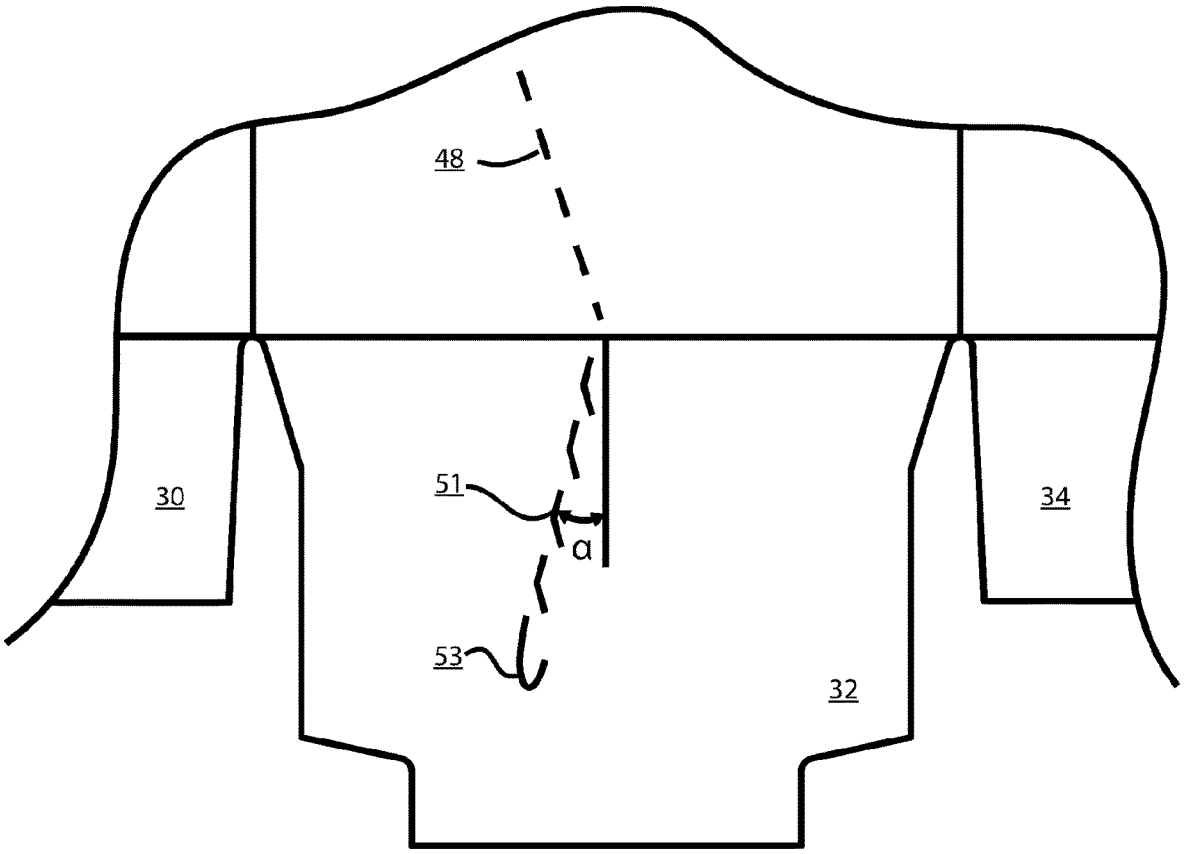
FIG. 8 is a close-up plan view of the first side exiting end flap of the blank of FIG. 1.

Dispenser pattern 40 also includes a first end dispenser pattern 60 disposed on first side exiting end flap 32. FIG. 8 shows a close-up view of first end dispenser pattern 60. First end dispenser pattern includes a first end tear line 51. First end tear line 51 extends from a point at or adjacent to fold line 21 that is at or adjacent to first side second tear line 48, to a point at or adjacent to a J-shaped cut 53. First end tear line 51 preferably consists of a plurality of shallow V-shaped cuts disposed in a relatively straight line defining an axis. The first leg of each of the V-shaped cuts is generally coincident with this axis, and the second leg is bent slightly out of axis toward the top of the constructed carton 90. First end tear line 51 extends in a predominantly transverse direction (i.e., toward the second side of the constructed carton 90) but is also angled down toward the carton's bottom at an angle $\alpha$from horizontal (with reference to the constructed carton 90). Angle $\alpha$ is preferably at least about 5 degrees. First end tear line 51 does not extend completely across first side exiting end flap 32, and J-shaped cut 53 is thus spaced inwardly a distance from the outer edge of first side exiting end flap 32. J-shaped cut 53 is configured to arrest further tearing of first side exiting end flap 32. In the illustrated first embodiment, the "hook" of J-shaped cut 53 faces up toward the top of the constructed carton 90.

Dispenser pattern 40 also includes a second side dispenser pattern 46 disposed on second side panel 18. Second side dispenser pattern 46 may generally mirror first side dispenser pattern 44. In the illustrated embodiment, second side dispenser pattern 46 is generally V-shaped and consists of a second side first tear line 49 and a second side second tear line 50 joined to one another via a rounded tear line 45 which forms the vertex of the V-shape. Second side first tear line 49 extends from a point at or adjacent to fold line 15 that is at or adjacent to second top tear line 42 to a point at or adjacent to rounded tear line 45. Second side tear first line 49 extends in a predominantly longitudinal direction (i.e., toward the bottom of the constructed carton 90), but is also angled toward the back end of the carton 90. Second side second tear line 50 extends from a point at or adjacent to rounded tear line 45 to a point at or adjacent to fold line 21. Second side second tear line 50 extends in a predominantly transverse direction (i.e., toward the front end of the constructed carton 90) but is also angled toward the top of the carton 90.

Dispenser pattern 40 also includes a second end dispenser pattern 62 disposed on second side exiting end flap 36. Second end dispenser pattern 62 may generally mirror first end dispenser pattern 60. Second end dispenser pattern 62 includes a second end tear line 52. Second end tear line 52 extends from a point at or adjacent to fold line 21 that is at or adjacent to second side second tear line 50, to a point at or adjacent to a J-shaped cut 54. Second end tear line 52 preferably consists of a plurality of shallow V-shaped cuts disposed in a relatively straight line defining an axis. The first leg of each of the V-shaped cuts is generally coincident with this axis, and the second leg is bent slightly out of axis toward the top of the constructed carton 90. Second end tear line 52 extends in a predominantly transverse direction (i.e., toward the first side of the constructed carton 90) but is also angled down toward the carton's bottom at an angle $\alpha$ from horizontal (with reference to the constructed carton 90). Angle $\alpha$ is preferably at least about 5 degrees. Second end tear line 52 does not extend completely across second side exiting end flap 36, and J-shaped cut 54 is thus spaced inwardly a distance from the outer edge of second side exiting end flap 36. J-shaped cut 54 is configured to arrest further tearing of second side exiting end flap 36. In the illustrated first embodiment, the "hook" of J-shaped cut 54 faces up toward the top of the constructed carton 90.

The dimensions of the blank 10 may be selected to accommodate defining or characteristic dimensions of articles to be accommodated within the carton 90. For example, the top panel 16 and bottom panel 12 can have a width W1 that generally corresponds to or slightly exceeds a height of containers C or other articles to be accommodated within the carton 90. When cylindrical or substantially cylindrical containers C are used, the first and second side panels 14, 18 can have, for example, a height H1 that generally corresponds to or slightly exceeds an integral multiple of a largest or characteristic diameter of the containers C. For example, if the containers C are to be stacked in two rows in the carton 90, the height H1 of the carton 90 can be about equal to or slightly greater than twice the containers' C largest or characteristic diameter.

The carton 90 may be erected from the blank 10 by gluing or otherwise adhering the adhesive flap 20 to the inner side of the bottom panel 12 so that the bottom panel 12, first side panel 14, top panel 16, and second side panel 18 may be opened or set up to form a generally tubular sleeve. The ends of the generally tubular sleeve may be closed by folding and adhering the back end flaps 22, 24, 26, 28 and the exiting end flaps 30, 32, 34, 36. The exterior surfaces of the bottom and top exiting end flaps 30, 34 can be, for example, glued to interior surfaces of the first and second side exiting end flaps 32, 36. Containers C, or other articles, can be loaded into the sleeve in a conventional manner at any time before one or both ends of the carton are closed by the end flaps 22, 24, 26, 28, 30, 32, 34, 36.

Figure 2:
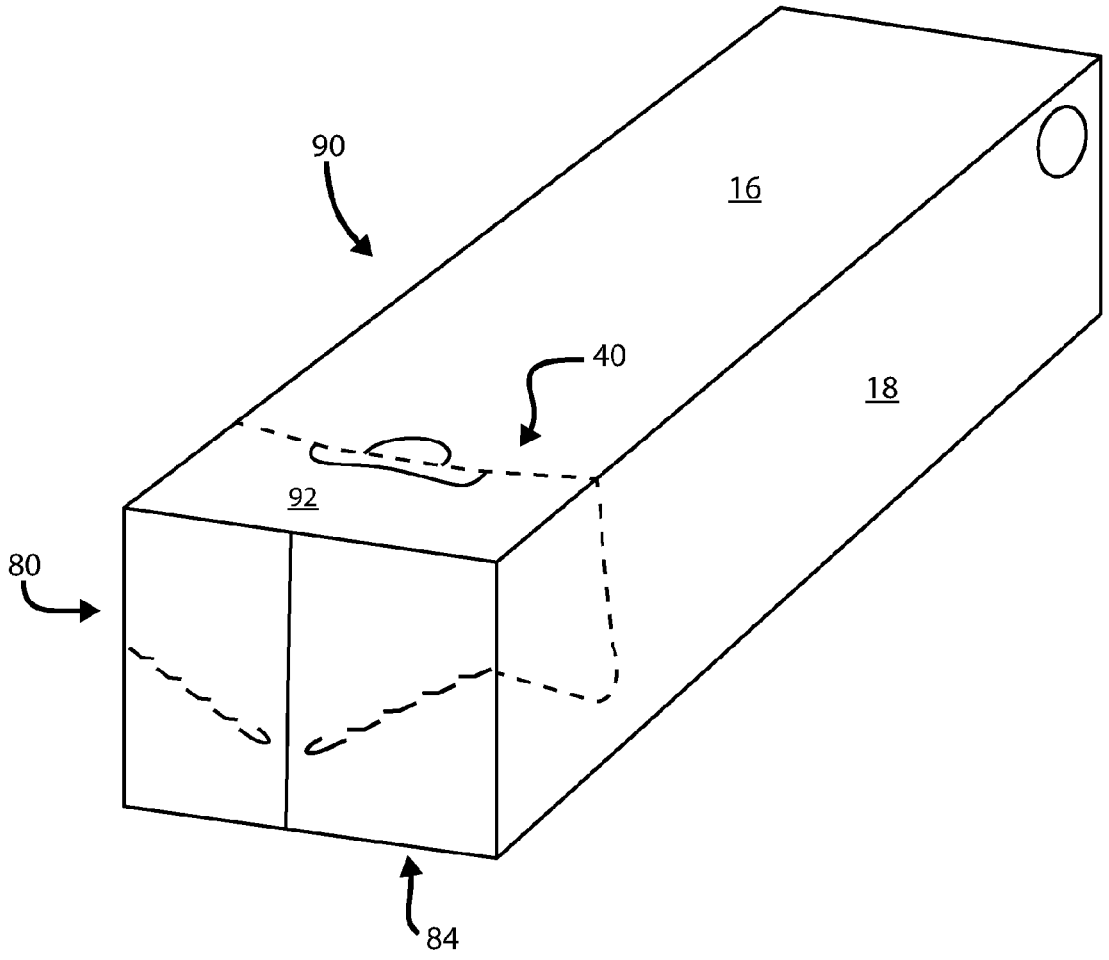
FIG. 2 is a perspective view of the carton formed from the blank of FIG. 1.

FIG. 2 is a perspective view of the carton 90 erected from the blank 10. In the erected carton 90, the back end flaps 22, 24, 26, 28 form a back end panel 82 and the exiting end flaps 30, 32, 34, 36 form a front or exiting end panel 84. The dispenser pattern 40 forms a dispenser 80 having a dispenser flap 92 that may be partially or completely removed to place the carton 90 in an open or dispensing configuration. Generally, however, it is intended that the dispenser flap 92 of the first embodiment be only partially removed from carton 90 during use.

Figure 3:
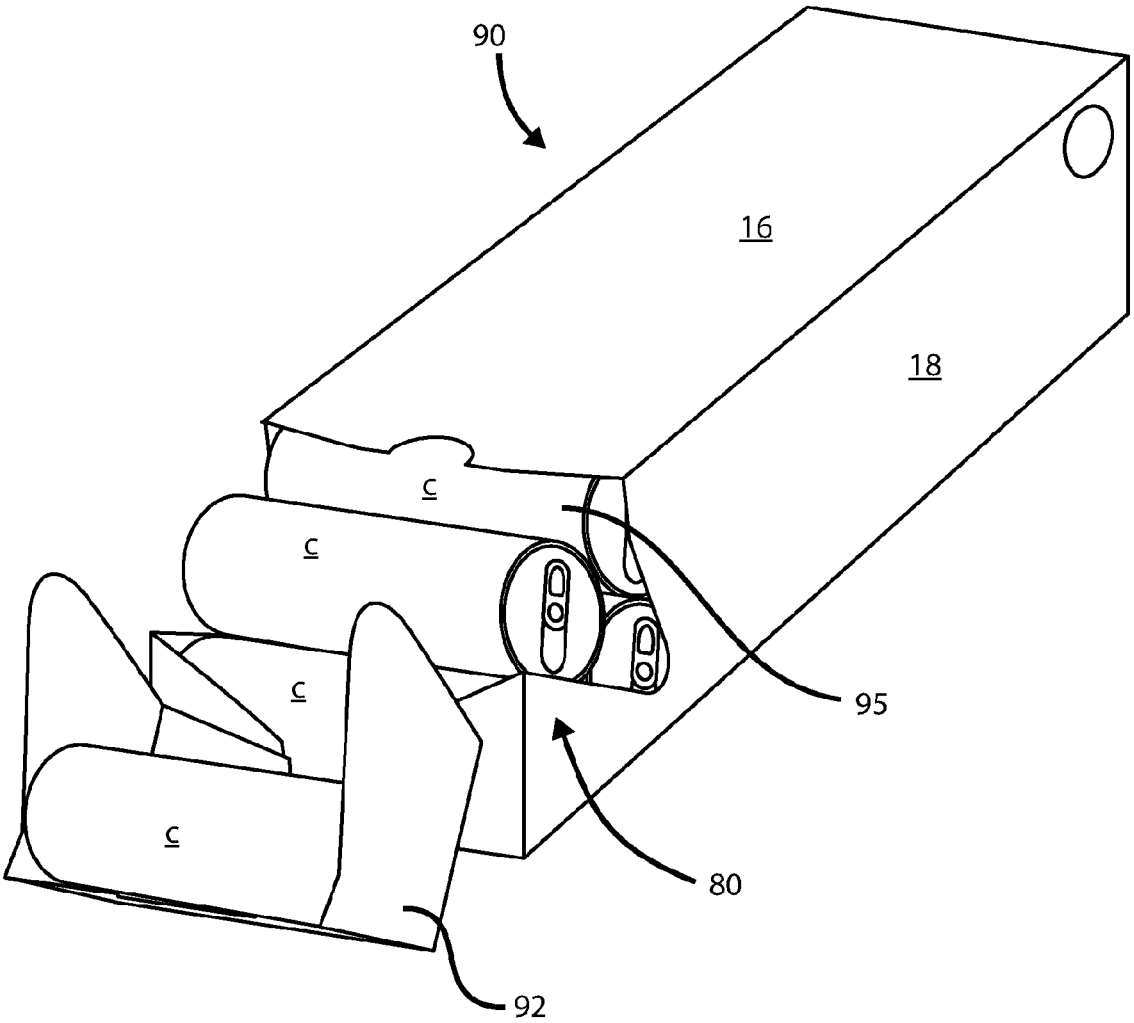
FIG. 3 is a perspective view of the carton of FIG. 2 in an open or dispensing configuration.

Opening of the dispenser 80 may be initiated by inserting one or more fingers into the carton 90 through cutout 55 of opening feature 66. The dispenser 80 is fully opened by pulling the dispenser flap 92 outwardly and downwardly and tearing the carton 90 along tear lines 41, 42, 47, 48, 49, 50, 51, 52. This tearing of carton 90 along tear lines 41, 42, 47, 48, 49, 50, 51, 52 causes the dispenser flap 92 to move in a pivoting-type motion about an imaginary line extending horizontally between J-shaped cuts 53, 54. The tearing of carton along 90 tear lines 51 and 52 may be arrested via the J-shaped cuts 53, 54 so as to leave the dispenser flap 92 partially connected to the remainder of the carton 90 via a now-folded segment of first exiting end flap 32 and second exiting end flap 36 that extends generally horizontally between J-shaped cuts 53, 54. The partial removal of dispenser flap 92 creates an opening 95 into the interior of the carton 90, allowing a user to remove an article C from therewithin. FIG. 3 shows carton 90 in an open or dispensing configuration following partial removal of dispenser flap 92. Opening of dispenser 80 may have a tendency to cause a front-most top article C to move into and be received within the interior of the now-inverted dispenser flap 92 as shown in FIG. 3, thereby facilitating the dispensing of the first article C. Particularly in the case where articles C are cans or otherwise generally cylindrical in shape, the remaining top row of articles C may have a tendency to roll forward such that each of the remaining top row articles C is received within a valley defined by the space between two adjacent lower-row articles C.

The downward angling of tear lines 51, 52 advantageously facilitates "automatic" tearing along these lines as the dispenser flap 92 is rotated out and down in a natural movement by a user, and prevents tear lines 51, 52 from inadvertently functioning as fold lines. It has been found that it is desirable to select an angle $\alpha$ greater than or equal to about 5 degrees in order to produce this type of "automatic" tearing functionality. The use of shallow V-shaped cuts for tear lines 51, 52 as disclosed has also been found to facilitate easier tearing along tear lines 51, 52 when the dispenser flap 92 is pulled and rotated in the manner described.

Figure 4:
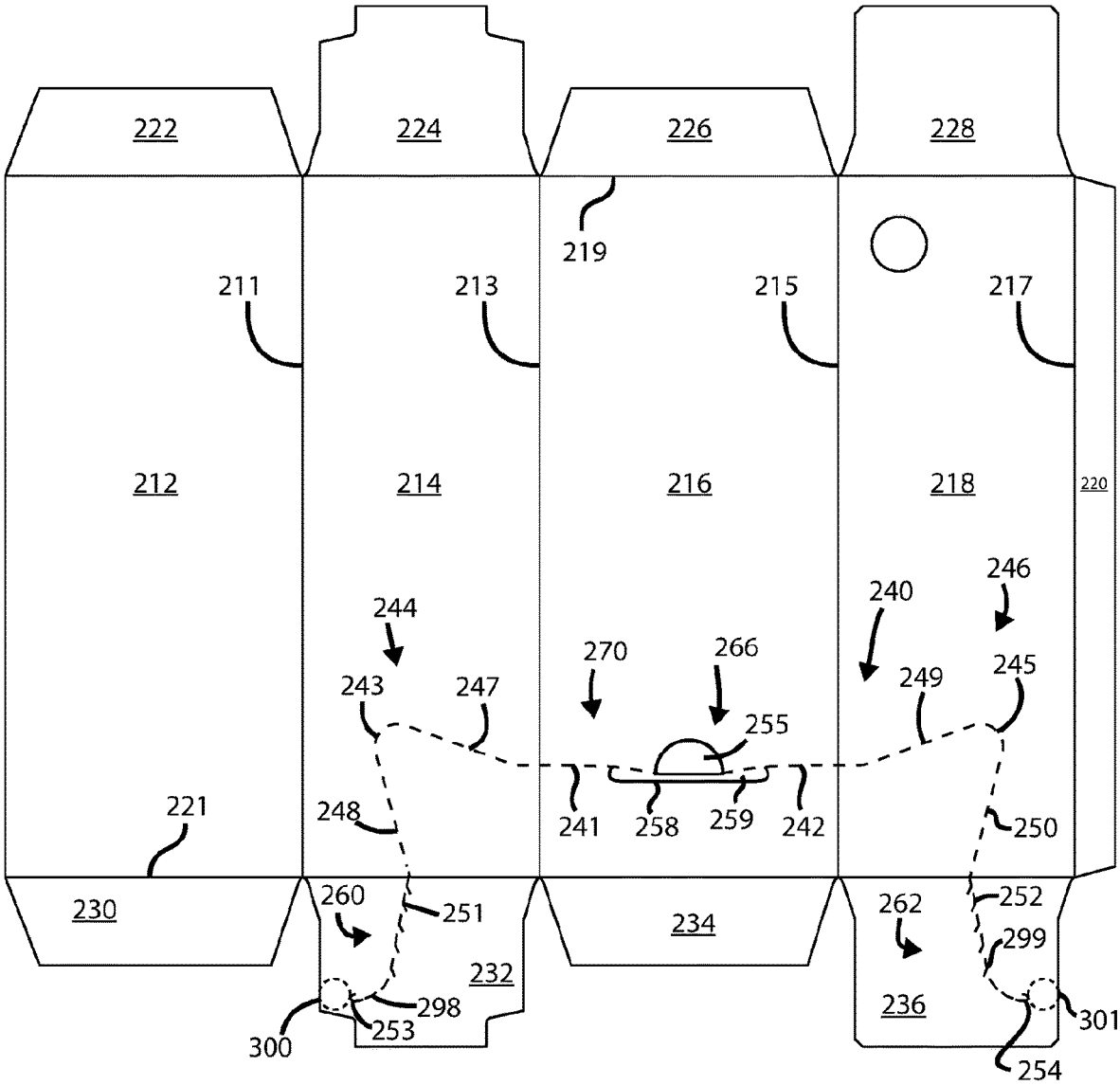
FIG. 4 is a plan view of a blank for forming a carton according to a second embodiment of the invention.

FIG. 4 is a plan view of a blank 210 used to form a carton 290 (see FIGS. 5-7) according to a second embodiment of the invention. Blank 210 and the corresponding carton 290 can be generally similar to the blank 10 and carton 90 discussed above, and like or similar reference numbers in the figures indicate like or similar elements. The difference between the first and second embodiments relates to first end dispenser pattern 260 disposed on first side exiting end flap 232, and the second end dispenser pattern 262 disposed on second side exiting end flap 236.

Figure 9:
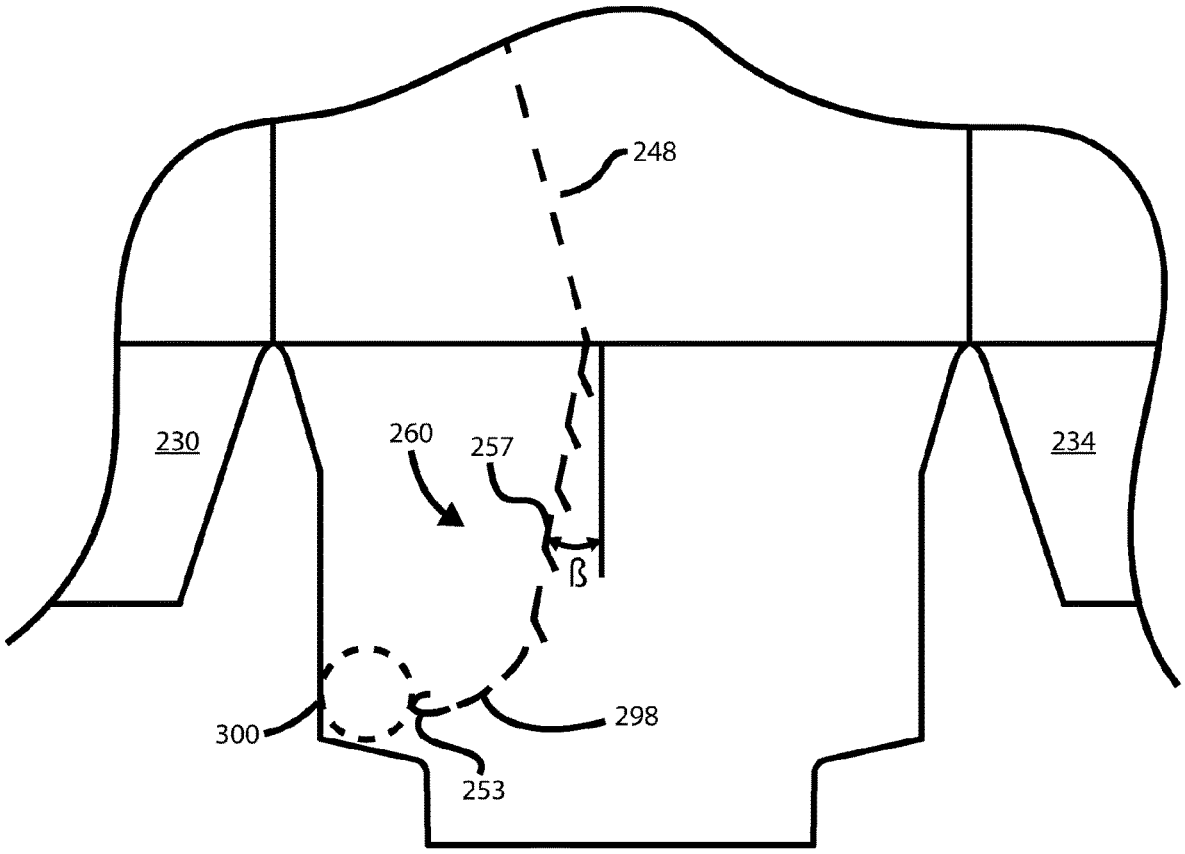
FIG. 9 is a close-up plan view of the first side exiting end flap of the blank of FIG. 4.

First end dispenser pattern 260 includes a first end first tear line 251. A close-up view of first end dispenser pattern 260 is shown in FIG. 9. First end first tear line 251 extends from a point at or adjacent to fold line 221 that is at or adjacent to first side second tear line 248, to a point at or adjacent to a first end second tear line 298. First end first tear line 251 preferably consists of a plurality of shallow V-shaped cuts disposed in a relatively straight line defining an axis. The first leg of the each of the V-shaped cuts is generally coincident with this axis, and the second leg is bent slightly out of axis toward the top of the constructed carton 290. First end first tear line 251 extends in a predominantly transverse direction (i.e., toward the second side of the constructed carton 290) but is also angled down toward the carton's bottom at an angle $\beta$ from horizontal (with reference to the constructed carton 290). Angle $\beta$ is preferably at least about 5 degrees. First end second tear line 298 is preferably shorter in length than first end first tear line 251 and curves down toward the bottom of the erected carton 290. First end second tear line 298 is preferably oriented in a generally downward direction. First end second tear line 298 extends to a point at or adjacent to a J-shaped cut 253. J-shaped cut 253 is configured to arrest further tearing of first side exiting end flap 232. In the illustrated second embodiment, the "hook" of the J-shaped cut 253 opens toward the interior of the curve of first end second tear line 298. First end dispenser pattern 260 does not extend completely across first side exiting end flap 232, and J-shaped cut 253 is thus spaced inwardly a distance from the outer edge of first side exiting end flap 232. The angling of first end first tear line 251 and the curvature of first end second tear line 298 place J-shaped cut 253 within relatively close proximity of the bottom edge of first side exiting end flap 232. J-shaped cut 253 is separated from the bottom edge of first side exiting end flap 232 by a region of first side exiting end flap 232 labeled 300 in FIGS. 4 and 9.

Second end dispenser pattern 262 may generally mirror first end dispenser pattern 260. Second end dispenser pattern 262 includes a second end first tear line 252. Second end first tear line 252 extends from a point at or adjacent to fold line 221 that is at or adjacent to second side second tear line 250, to a point at or adjacent to a second end second tear line 299. Second end first tear line 252 preferably consists of a plurality of shallow V-shaped cuts disposed in a relatively straight line defining an axis. The first leg of the each of the V-shaped cuts is generally coincident with this axis, and the second leg is bent slightly out of axis toward the top of the constructed carton 290. Second end first tear line 252 extends in a predominantly transverse direction (i.e., toward the second side of the constructed carton 290) but is also angled down toward the carton's bottom at an angle β from horizontal (with reference to the constructed carton 290). Angle β is preferably at least about 5 degrees. Second end second tear line 299 is preferably shorter in length than second end first tear line 252 and curves down toward the bottom of the erected carton 290. Second end second tear line 299 is preferably oriented in a generally downward direction. Second end second tear line 299 extends to a point at or adjacent to a J-shaped cut 254. J-shaped cut 254 is configured to arrest further tearing of second side exiting end flap 236. In the illustrated second embodiment, the "hook" of the J-shaped cut 254 opens toward the interior of the curve of second end second tear line 299. Second end dispenser pattern 262 does not extend completely across second side exiting end flap 236, and J-shaped cut 254 is thus spaced inwardly a distance from the outer edge of second side exiting end flap 236. The angling of second end first tear line 252 and the curvature of second end second tear line 299 place J-shaped cut 254 within relatively close proximity of the bottom edge of second side exiting end flap 236. J-shaped cut 254 is separated from the bottom edge of second side exiting end flap 236 by a region of second side exiting end flap 236 labeled 301 in FIG. 4.

Carton 290 can be erected in a manner similar to that described above in connection with carton 90.

Figure 5:
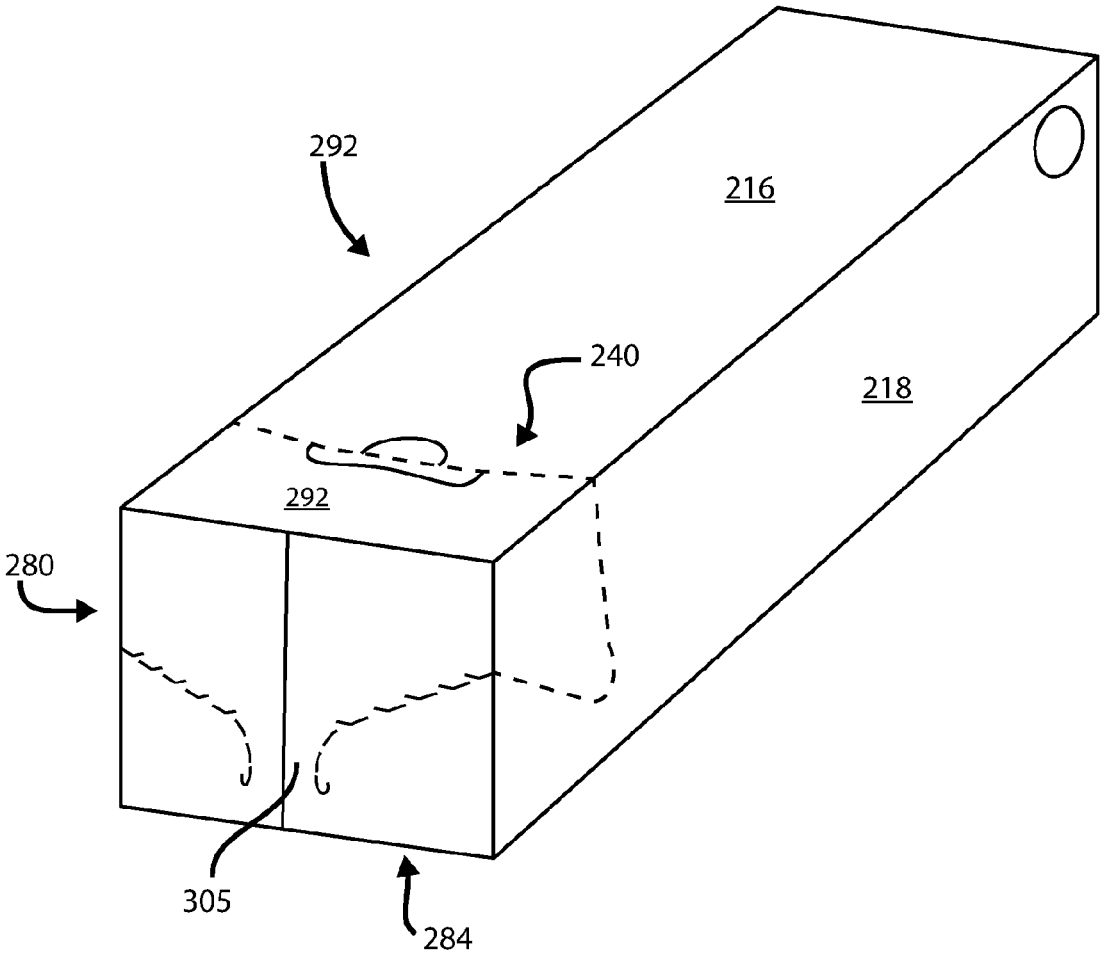
FIG. 5 is a perspective view of the carton formed from the blank of FIG. 4.
Figure 6:
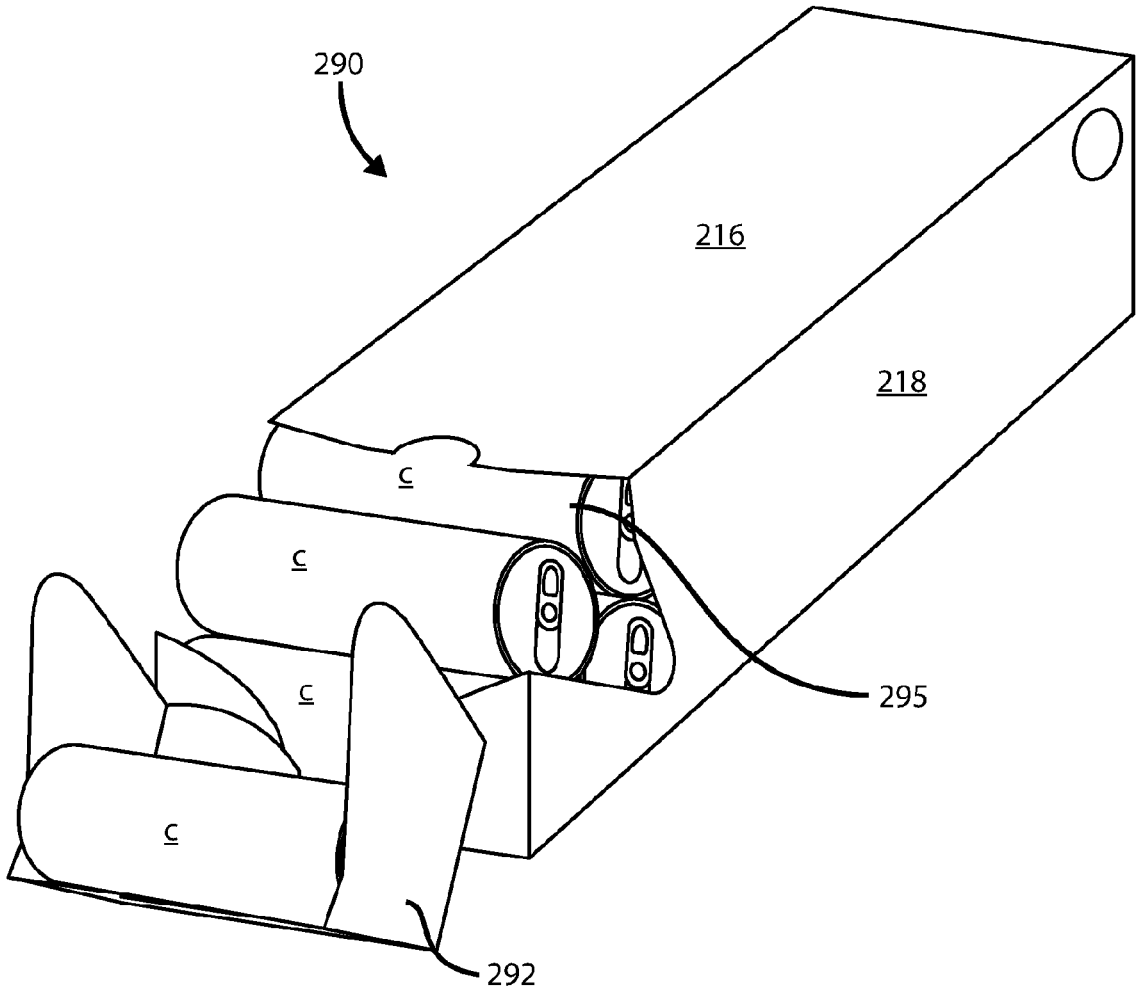
FIG. 6 is a perspective view of the carton of FIG. 5 in a first open or dispensing configuration in which the dispensing flap remains partially connected to the remainder of the carton.

FIG. 5 is a perspective view of the carton 290 erected from the blank 210. Opening of the dispenser 280 of carton 290 may be initiated in a manner similar to that described above in connection with carton 90. Thus, a user may insert a finger or fingers into the carton 290 through cutout 255 of the opening feature 266. The dispenser 280 is fully opened by pulling the dispenser flap 292 outwardly and downwardly and tearing carton 290 along tear lines 241, 242, 247, 248, 249, 250, 251, 252, 298, 299. The tearing of carton 290 along tear lines 298 and 298 may be arrested via the J-shaped cuts 253, 254 so as to leave the dispenser flap 292 partially connected to the remainder of the carton 290 via a flexible bridging portion 305 (see FIG. 5) generally defined by the region of exiting end panel 284 that extends between first end second tear line 298 and second end second tear line 299. The inclusion of generally vertically oriented first end second tear line 298 and second end second tear line 299 in the second embodiment tends to create a flexible bridging portion 305 as the connection between the dispenser flap 292 and the remainder of the carton 290 rather than a fold-line type connection (as tends to be created in the first embodiment). FIG. 6 shows carton 290 in a first open or dispensing configuration following partial removal of dispenser flap 292.

Figure 7:
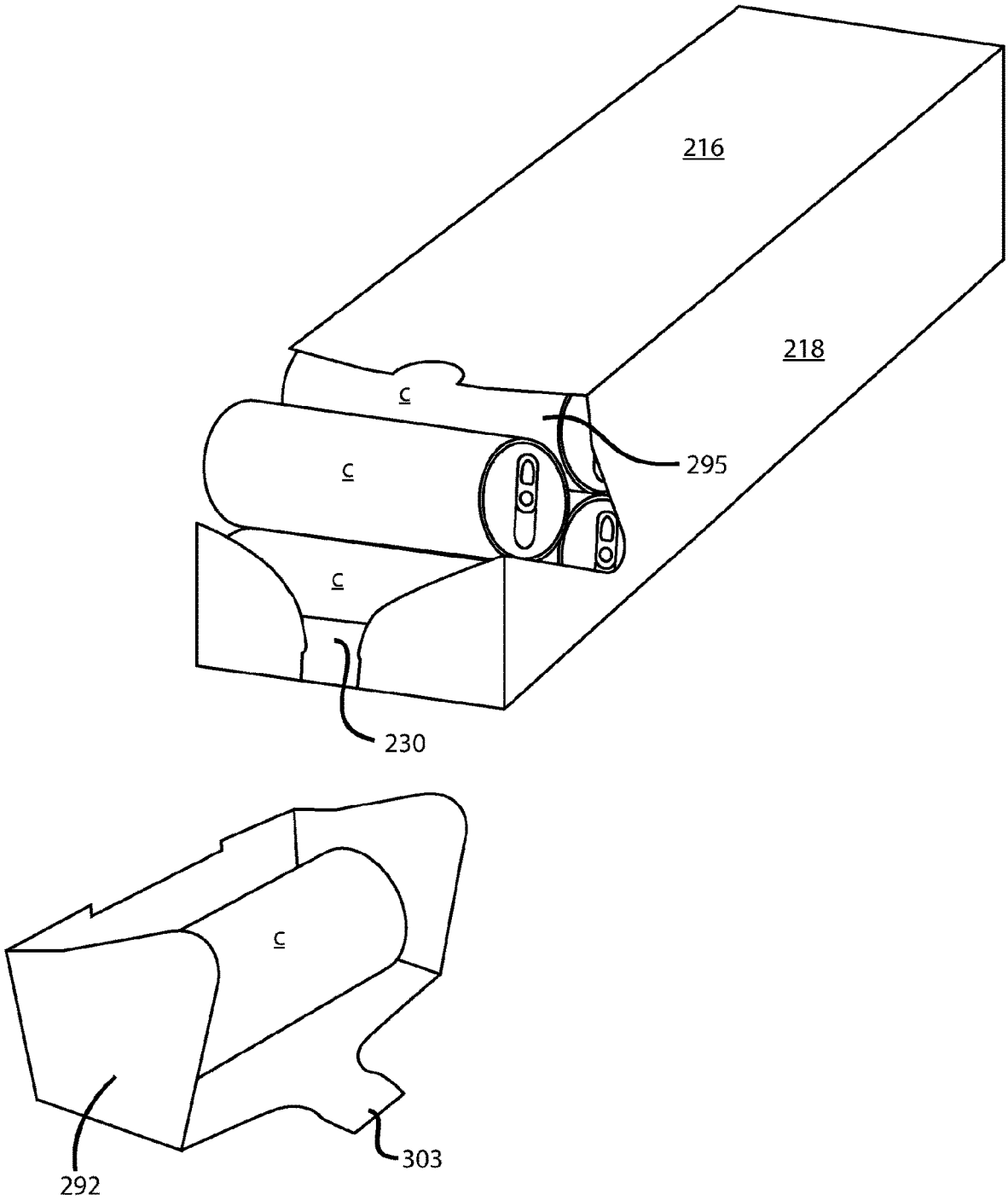
FIG. 7 is a perspective view of the carton of FIG. 5 in a second open or dispensing configuration in which the dispensing flap is completely removed from the remainder of the carton.

Alternatively, and at a user's option, the dispenser flap 292 may be fully removed by continuing to pull the dispenser flap 292 in a downward and/or outward direction. The configuration of first and second end dispenser patterns 260, 262 is such that, in the event of such continued application of force, first and second end flaps 232, 236 will tend to tear down from J-shaped cuts 253, 254 through the regions 300, 301 in a more or less vertical direction, thereby separating the dispenser flap 292 completely from the remainder of the carton 290. This tearing through regions 300, 301 is accomplished without the guide of any tear lines in these regions. FIG. 7 shows carton 290 in a second open or dispensing configuration following the complete separation of dispenser flap 292 from the remainder of carton 290.

As with the first embodiment, the downward angling of tear lines 251, 252 advantageously facilitates "automatic" tearing along these lines as the dispenser flap 292 is rotated out and down in a natural movement by a user, and prevents tear lines 251, 252 from inadvertently functioning as fold lines. It has been found that it is desirable to select an angle β greater than or equal to about 5 degrees in order to produce this type of "automatic" tearing functionality. The use of shallow V-shaped cuts for tear lines 251, 252 as disclosed has also been found to facilitate easier tearing along tear lines 251, 252 when the dispenser flap 292 is pulled and rotated in the manner described. The configuration of the first and second end dispenser patterns 260, 262 also advantageously gives the user greater control over the partial or complete removal of dispenser flap 292. J-shaped cuts 253, 254 provide a natural stopping point for the tearing of first side and second side exiting end flaps 232, 236 and provide tactile feedback to the user to indicate that the dispenser 280 has reached its fully-open, connected configuration. However, should the user wish to fully remove the dispenser flap 292, the configuration of first and second end dispenser patterns 260, 262 allows the user to do so via a continued, natural motion with relative ease. In certain embodiment, the underside of flexible bridging portion 305 and/or the region of exiting end panel 284 extending between regions 300 and 301, or portions thereof, may be glued or otherwise adhered to bottom exiting end flap 230. In such embodiments, complete separation of dispenser flap 292 from the remainder of the carton 290 may necessitate additional tearing or peeling to sever these connection(s).

It can be appreciated that various changes may be made within the scope of the present invention. For example, the size and shape of the panels may be adjusted to accommodate articles of differing size or shape.

It will be recognized that as used herein, directional references such as "top", "base", "front", "back", "end", "side", "inner", "outer", "upper" and "lower" do not limit the respective panels to such orientation, but merely serve to distinguish these panels from one another. Any reference to "hinged connection" should not be construed as necessarily referring to a single fold line only; indeed it is envisaged that a hinged connection can be formed from one or more of the following: a short slit, a frangible line or a fold line, without departing from the scope of the invention. It can be appreciated that various changes may be made within the scope of the present invention. For example, the size and shape of the panels may be adjusted to accommodate articles of differing size or shape.

As used herein, the terms "hinged connection" and "fold line" each refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged connection" should not be construed as necessarily referring to a single fold line only; indeed a hinged connection can be formed from one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the terms "tear line", "weakened line of severance", "severance line" and "frangible line" each may refer to all manner of lines formed in the blank or substrate of sheet material that facilitate separating portions of the blank or substrate of sheet material from one another, or otherwise that indicate optimal separation locations on the blank or substrate. As used herein, the terms "tear line", "weakened line of severance", "severance line" and "frangible line" each may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines, tear lines, weakened lines of severance, frangible lines and severance lines can each includes elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a frangible line. The line of perforations can be designed to facilitate folding and resist breaking to provide a fold line, to facilitate folding and facilitate breaking with more effort to provide a frangible fold line, or to facilitate breaking with little effort to provide a frangible line.

The invention claimed is:

1. A blank for forming a carton for containing a plurality of articles, the blank comprising:

a plurality of main panels hinged together in a linear series, the plurality of main panels configured to form a tubular structure in a set-up carton, the plurality of main panels comprising a bottom panel, a first side panel, a top panel, and a second side panel;

a plurality of exiting end flaps configured to form a front panel in the set-up carton, the front panel being configured to close a front end of the tubular structure, the plurality of exiting end flaps comprising a first side exiting end flap hingedly connected to said first side panel along a first marginal area of the blank and a second side exiting end flap hingedly connected to said second side panel along said first marginal area of the blank;

a dispenser pattern extending through the top panel, the first side panel, the second side panel, and the front panel, wherein the dispenser pattern comprises a first end dispenser pattern formed in the first side exiting end flap and a second end dispenser pattern formed in the second side exiting end flap, wherein the first end dispenser pattern comprises a first end first tear line and the second end dispenser pattern comprises a second end first tear line, and wherein the first end first tear line and the second end first tear line are configured to extend downwardly toward each other from opposite sides of the front panel in the set-up carton, and wherein said first and second end dispenser patterns do not extend completely across respective first and second side exiting end flaps but stop short of an outer edge of respective first and second side exiting end flaps, wherein the first end first tear line and second end first tear line are configured to define at least in part a lower edge of an at least partially removable dispenser in the set-up carton, wherein said first end first tear line defines a first axis and said second end first tear line defines a second axis, wherein a first angle between said first axis and a horizontal axis of said front panel is at least about 5 degrees, wherein a second angle between said second axis and said horizontal axis of said front panel is at least about 5 degrees.

2. The blank of claim 1, wherein said dispenser pattern is configured so as to leave at least a portion of said dispenser connected to a remaining portion of the set-up carton when said dispenser is fully opened.

3. The blank of claim 1, wherein said dispenser pattern is configured so as to give a user of the set-up carton the option of either partially or completely removing the dispenser from a remaining portion of the set-up carton when said dispenser is fully opened.

4. The blank of claim 1, wherein said first end first tear line comprises a first plurality of shallow V-shaped cuts, each of said first plurality of shallow V-shaped cuts comprising a first leg generally coincident with an axis of said first end tear first line and a second leg angled slightly out of said axis of said first end first tear line and toward a top of the set-up carton, wherein said second end first tear line comprises a second plurality of shallow V-shaped cuts, each of said second plurality of shallow V-shaped cuts comprising a first leg generally coincident with an axis of said second end first tear line and a second leg angled slightly out of said axis of said second end first tear line and toward said top of the set-up carton.

5. The blank of claim 1, further comprising a first side dispenser pattern formed in the first side panel and a second side dispenser pattern formed in the second side panel, the first side dispenser pattern comprising a first side first tear line angled obliquely toward a back and bottom of the set-up carton and a first side second tear line angled obliquely toward the front panel and top of the set-up carton, a terminal end of the first side second tear line being disposed at or adjacent to a beginning end of said first end first tear line, the second side dispenser pattern comprising a second side first tear line angled obliquely toward the back and bottom of the set-up carton and a second side second tear line angled obliquely toward the front panel and top of the set-up carton, a terminal end of the second side second tear line being disposed at or adjacent to a beginning end of said second end first tear line.

6. The blank of claim 5, wherein said first side dispenser pattern comprises a first side curved tear line connecting said first side first tear line and said first side second tear line, and wherein said second side dispenser pattern comprises a second side curved tear line connecting said second side first tear line and said second side second tear line.

7. The blank of claim 1, wherein said first end dispenser pattern comprises a first end second tear line disposed at or adjacent to a terminal end of said first end first tear line, wherein said first end second tear line curves down toward a bottom of the set-up carton, wherein said second end dispenser pattern comprises a second end second tear line disposed at or adjacent to a terminal end of said second end first tear line, wherein said second end second tear line curves down toward a bottom of the set-up carton.

8. The blank of claim 7, wherein said first end dispenser pattern comprises a first J-shaped cut disposed at or adjacent a terminal end of said first end second tear line, wherein said second end dispenser pattern comprises a second J-shaped cut disposed at or adjacent a terminal end of said second end second tear line, wherein said first J-shaped cut is disposed within relatively close proximity of a bottom edge of said first side exiting end flap, wherein said second J-shaped cut is disposed within relatively close proximity of a bottom edge of said second side exiting end flap.

9. A blank for forming a carton for containing a plurality of articles, the blank comprising:

a plurality of main panels hinged together in a linear series, the plurality of main panels configured to form a tubular structure in a set-up carton, the plurality of main panels comprising a bottom panel, a first side panel, a top panel, and a second side panel;

a plurality of exiting end flaps configured to form a front panel in the set-up carton, the front panel being configured to close a front end of the tubular structure, the plurality of exiting end flaps comprising a first side exiting end flap hingedly connected to said first side panel along a first marginal area of the blank and a second side exiting end flap hingedly connected to said second side panel along said first marginal area of the blank;

a dispenser pattern extending through the top panel, the first side panel, the second side panel, and the front panel, wherein the dispenser pattern comprises a first end dispenser pattern formed in the first side exiting end flap and a second end dispenser pattern formed in the second side exiting end flap, wherein the first end dispenser pattern comprises a first end first tear line and the second end dispenser pattern comprises a second end first tear line, and wherein the first end first tear line and the second end first tear line are configured to extend downwardly toward each other from opposite sides of the front panel in the set-up carton, and wherein said first and second end dispenser patterns do not extend completely across respective first and second side exiting end flaps but stop short of an outer edge of respective first and second side exiting end flaps, wherein the first end first tear line and second end first tear line are configured to define at least in part a lower edge of an at least partially removable dispenser in the set-up carton, wherein said first end dispenser pattern comprises a first J-shaped cut disposed at or adjacent to a terminal end of said first end first tear line, and wherein said second end dispenser pattern comprises a second J-shaped cut disposed at or adjacent to a terminal end of said second end first tear line, said first and second J-shaped cuts being configured to arrest further tearing of the front panel in the set-up carton.

10. A carton and a plurality of articles contained therein, the carton comprising:

a top panel;

a bottom panel;

a first side panel coupled to both the top panel and the bottom panel;

a second side panel disposed opposite the first side panel and coupled to both the top panel and the bottom panel;

a back end panel disposed at a back end of the carton;

an exiting end panel disposed at a front end of the carton, the exiting end panel comprising a first side exiting end flap and a second side exiting end flap;

a dispenser defined by a dispenser pattern, the dispenser pattern defining a dispenser flap that is separable along said dispenser pattern to form an opening into an interior of said carton, said dispenser pattern extending at least through the top panel, the first side panel, the second side panel, and the exiting end panel, wherein the dispenser pattern comprises a first end dispenser pattern formed in the first side exiting end flap and a second end dispenser pattern formed in the second side exiting end flap, wherein the first end dispenser pattern comprises a first end first tear line and the second end dispenser pattern comprises a second end first tear line, and wherein the first end first tear line and the second end first tear line extend downwardly toward one another from opposite sides of the exiting end panel, and wherein said first and second end dispenser patterns do not extend completely across respective first and second side exiting end flaps but stop short of an outer edge of respective first and second side exiting end flaps, wherein said first end first tear line defines a first axis and said second end first tear line defines a second axis, wherein a first angle between said first axis and a horizontal axis of said front panel is at least about 5 degrees, wherein a second angle between said second axis and said horizontal axis of said front panel is at least about 5 degrees.

11. The carton of claim 10, wherein said plurality of containers comprises a plurality of cans.

12. The carton of claim 11, wherein said plurality of cans are arranged on their sides in at least two stacked rows, wherein a width of said top panel and said bottom panel is about equal to or slightly greater than a characteristic height of each of said plurality of cans.

13. The carton of claim 10, wherein said dispenser pattern is configured so as to leave at least a portion of said dispenser flap connected to a remaining portion of the carton when said dispenser is fully opened.

14. The carton of claim 10, wherein said dispenser pattern is configured so as to give a user of the carton the option of either partially or completely removing the dispenser flap from a remaining portion of the carton when said dispenser is fully opened.

15. The carton of claim 10, wherein said first end dispenser pattern comprises a first J-shaped cut disposed at or adjacent to a terminal end of said first end first tear line, and wherein said second end dispenser pattern comprises a second J-shaped cut disposed at or adjacent to a terminal end of said second end first tear line, said first and second J-shaped cuts being configured to arrest further tearing of the exiting end panel.

16. The carton of claim 10, wherein said first end first tear line comprises a first plurality of shallow V-shaped cuts, each of said first plurality of shallow V-shaped cuts comprising a first leg generally coincident with an axis of said first end tear first line and a second leg angled slightly out of said axis of said first end first tear line and toward the top panel, wherein said second end first tear line comprises a second plurality of shallow V-shaped cuts, each of said second plurality of shallow V-shaped cuts comprising a first leg generally coincident with an axis of said second end first tear line and a second leg angled slightly out of said axis of said second end first tear line and toward the top panel.

17. The carton of claim 10, further comprising a first side dispenser pattern formed in the first side panel and a second side dispenser pattern formed in the second side panel, the first side dispenser pattern comprising a first side first tear line angled obliquely toward the back and bottom panels of the carton and a first side second tear line angled obliquely toward the exiting end panel and top panel, a terminal end of the first side second tear line being disposed at or adjacent to a beginning end of said first end first tear line, the second side dispenser pattern comprising a second side first tear line angled obliquely toward the back and bottom panels and a second side second tear line angled obliquely toward the exiting end panel and top panel, a terminal end of the second side second tear line being disposed at or adjacent to a beginning end of said second end first tear line.

18. The carton of claim 17, wherein said first side dispenser pattern comprises a first side curved tear line connecting said first side first tear line and said first side second tear line, and wherein said second side dispenser pattern comprises a second side curved tear line connecting said second side first tear line and said second side second tear line.

19. The carton of claim 10, wherein said first end dispenser pattern comprises a first side second tear line disposed at or adjacent to a terminal end of said first end first tear line, wherein said first end second tear line curves down toward the bottom panel, wherein said second end dispenser pattern comprises a second end second tear line disposed at or adjacent to a terminal end of said second end first tear line, wherein said second end second tear line curves down toward the bottom panel.

* * * * *